US005327838A

United States Patent [19]

Beltman

[11] Patent Number: 5,327,838

[45] Date of Patent: Jul. 12, 1994

[54] PLAY TABLE WITH SELF-CONTAINED STORAGE

[76] Inventor: Charles H. Beltman, P.O. Box 6707, Grand Rapids, Mich. 49516

[21] Appl. No.: 59,982

[22] Filed: May 12, 1993

[51] Int. Cl.[5] ..... A47B 85/00
[52] U.S. Cl. ..... 108/25; 108/26
[58] Field of Search ..... 108/25, 26

[56] References Cited

U.S. PATENT DOCUMENTS

| | | | |
|---|---|---|---|
| 882,064 | 3/1908 | Howlett | 108/25 |
| 1,906,213 | 4/1933 | Neuschutz et al. | 108/25 |
| 4,427,391 | 1/1984 | Berman | 108/26 X |
| 4,747,352 | 5/1988 | Guidry et al. | 108/26 X |
| 5,055,081 | 10/1991 | Nayak | 108/26 X |
| 5,085,153 | 2/1992 | McKee | 108/25 X |
| 5,218,912 | 6/1993 | Buske | 108/26 |

FOREIGN PATENT DOCUMENTS

| | | | |
|---|---|---|---|
| 196741 | 5/1923 | United Kingdom | 100/25 |

*Primary Examiner*—José V. Chen
*Attorney, Agent, or Firm*—Warner, Norcross & Judd

[57] ABSTRACT

A play table with integral storage areas accessible through the play surface has a frame which supports a horizontal board having one or more openings. A removable storage bin is suspended within each opening. Atop each opening, a removable panel is provided. Preferably, the panels collectively cover the entire surface area of the board, thus providing a smooth play or work surface. When articles stored in a bin are needed, the panel overlying the bin is removed and its contents withdrawn, either piecemeal or by removing the bin itself. The panel then is replaced atop the opening, thus restoring the smooth play surface to its entirety. When the articles need to be returned to the storage bin, the appropriate panel is removed and the articles may either be swept or placed into the bin.

20 Claims, 1 Drawing Sheet

PLAY TABLE WITH SELF-CONTAINED STORAGE

BACKGROUND OF THE INVENTION

The invention relates to a table with integral storage areas accessible through the work surface.

Tables of one form or another have long been used for storing articles in proximity to a surface on which the articles are used. A typical desk is a common example. Desks commonly are comprised of one or more drawers located below a flat top surface. Articles can be removed easily from a desk drawer and placed on the top surface to be used as desired.

In certain contexts, there is a heightened need for storing articles in the same table having the surface on which the articles are to be used. Perhaps the best example of this is the context of children playing with a number of toys. In such a situation, it is desirable that the toys be stored as near as possible to the location where the children are to play with the toys; in this manner, the possibility of toys being scattered is reduced, while the possibility of toys neatly reaching their storage area is increased.

Play tables are known in which storage space is provided in a children's play table. One such table, manufactured by Funblock Tables, provides drawers for storing toys underneath the flat top surface of the table. The drawers can be drawn from underneath the table to remove toys for playtime or to return the toys to storage. Another table, manufactured by Table Toys, Inc., provides a play surface having raised bumps which accept interlocking blocks. In the middle of the play surface is an opening. Underneath the opening is a net attached to the underside of the play surface. Toys may be "swept" into the opening for storage within the net.

These play tables all have disadvantages. The table manufactured by Table Toys, Inc. is ill-suited for uses other than playing with the interlocking blocks. Children may be disinclined or forget to open a drawer fitting underneath the table top in order to return the toys to storage. Furthermore, even if such a drawer is opened, the child could not sweep the toys from the play surface into the drawer, but rather must replace them piece by piece, due to the raised edges surrounding the entire play surface. In the hole-and-net arrangement, the storage volume of the net is inversely proportional to the surface area of the play table. Thus, the advantages of storage are offset by the disadvantage of reduced surface area on the table. Furthermore, the net cannot easily be detached by a child wishing to dump the entire contents of the net onto the surface of the play table. Finally, children cannot easily reach toys stored in the net because the opening is in the center of the play surface, far from the edges of the table.

SUMMARY OF THE INVENTION

The present invention provides a table capable of storing articles underneath the entire area of the table top without decreasing the surface area of the table top.

The table has a frame which supports a bin-support board having one or more openings. Within each opening, a removable storage bin is suspended. A removable panel is placed over each bin. Thus, the table top is comprised of the panels collectively, along with whatever surface area of the board is uncovered by panels. In the preferred embodiment, the peripheral bin lips are recessed below the top surface of the bin-support board. Consequently, articles on the table can be easily swept into any one of the uncovered bins. The panels preferably cover the entire surface area of the board, and the top surfaces of the panels all are flush with one another, thus providing a smooth playing surface. Further preferably, the table frame extends above the play surface on all sides of the table thus providing a barrier which prevents toys from falling off of the table.

When articles stored in a bin are needed, the panel overlying the bin is removed so that the articles can be withdrawn, either piecemeal or by pulling the entire bin out of the opening in preparation for dumping the contents onto the remaining surface of the play table. If the bin has been removed, it is returned to its place within the opening. The panel is returned to its position overlying the opening, thus restoring the surface area of the table top to its entirety. When the articles need to be returned to a storage bin, the appropriate panel is removed and the articles are either placed in the bin or pushed or swept from the table top so as to fall into the bin.

DESCRIPTION OF THE PREFERRED EMBODIMENTS

Figure 3:
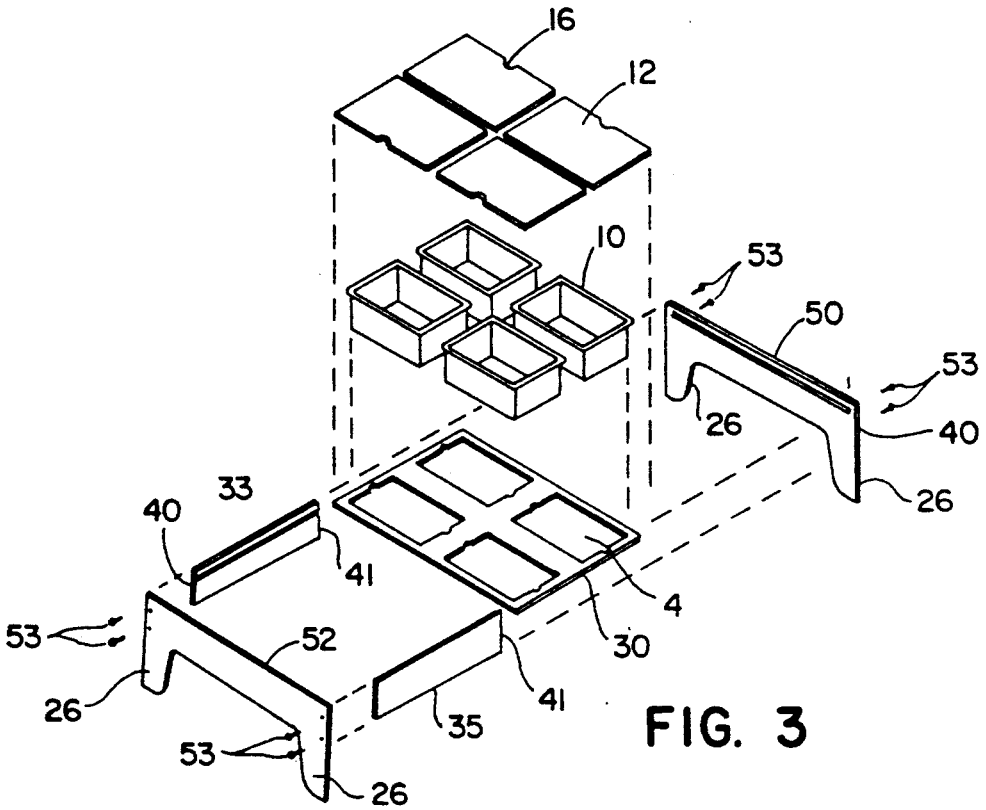
FIG. 3 is an exploded perspective view of the table.
Figure 1:
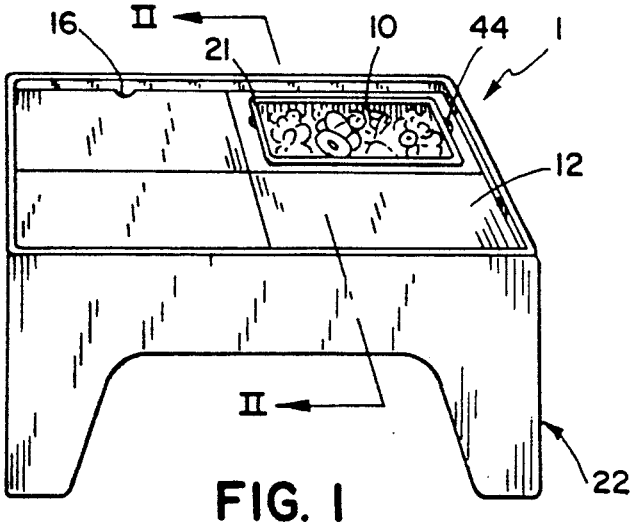
FIG. 1 is a perspective view of the table with one panel removed.

By way of disclosing a preferred embodiment, and not by way of limitation, there is shown in the drawings the table 1 of the present invention. As shown in FIGS. 1 and 3, the table is comprised of a frame 22, a support board 30 supported by the frame 22 and defining four openings 4, a bin 10 disposed within each opening 4, and a panel 12 overlying each bin 10.

Referring to FIG. 3, the frame is comprised of four frame members 50, 52, 33, 35, which may be composed of wood, plastic, or any number of other suitable materials. Frame members 50, 52 are of identical size and shape, and frame members 33, 35 are of identical size and shape. Each of frame members 50, 52 has a pair of legs 26 at both of its opposite ends and has a width substantially identical to the width of the board 30. Frame members 33, 35 both are rectangular with a length substantially identical to the length of the board 30. All of the frame members 33, 35, 50, and 52 include a channel or groove 40 aligned with all of the other grooves. The grooves are parallel to and somewhat below the top edge of each piece.

Frame members 50, 52 are attached to frame members 33 and 35 by means familiar to those skilled in the art, such as the illustrated screws 53, preferably so that the top edges of frame members 33, 35 are both flush with the top edges of frame members 50 and 52.

Figure 2:
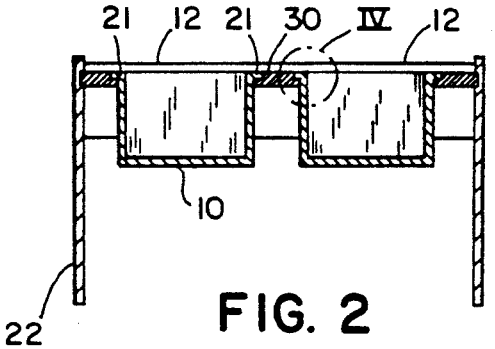
FIG. 2 is a cross section of the table taken along the line I—I of FIG. 1.
Figure 4:
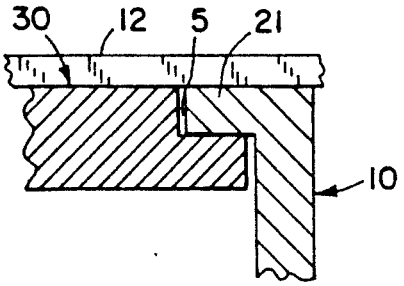
FIG. 4 is an enlarged fragmentary view of the area within line IV in FIG. 2.

The board 30 is entrapped and retained within the grooves 40 in frame members 33, 35, 50 and 52. The board 30 defines four rectangular openings 4. Referring now to FIGS. 2 and 4, a bin or basket 10 is suspended from the board 30 so that the bin 10 hangs through each opening 4. Each bin 10 has a peripheral lip 21 by which the bin 10 is suspended from the board 30. Toys or the like may be stored in the bin 10. As most clearly seen in FIG. 4, the opening 4 includes a recessed shoulder 5 so that, when the bin 10 hangs through the opening 4, the bins are flush with the upper surface of the board 4. Thumb holes 44 are provided to ease removal of the bin 10 from the opening 4.

A panel 12 is placed atop each bin 10. Ideally, the top surface of each panel is flush with the adjacent panels so as to provide a smooth area for play or work. The panels 12 are dimensioned so that together they fully cover the board 4. The bottom surface of the panel 12 lies against the top surface of the board 30. The panels 12 cover the entire surface of the board 30, and the top surfaces of the panels 12 all are flush with one another, thus providing a smooth tabletop. The panels 12 also may each have a notch or thumb hole 16 to ease removal from atop the bins. As best seen in FIG. 1, each frame member extends above the panels 12 to aid in retaining objects on the table top.

Assembly and Use

The assembly and use of the play table will now be described. Frame members 33, 35, are attached perpendicularly to frame member 52 on opposite ends of frame member 52. The board 30 is inserted into the grooves 40 in frame members 33, 35, and then slid until the forward edge of the board 30 is inserted into the groove 40 in frame member 52. The length of the board 30 is chosen so that the trailing edge of the board 30 is not flush with the ends 41 of frame members 33, 35, but rather extends beyond the ends 41 of frame members 33, 35. The trailing edge of the board 30 then is fitted into the slot 40 of frame member 50. Frame member 50 then is attached to the ends 1 of frame members 33, 35. In this manner, the board is disposed below the tops of all four frame members, so that the board is surrounded by a barrier which prevent toys or the like scattered around the board from falling off the board.

When articles stored in a bin are needed, the panel overlying the bin is removed so that the articles can be withdrawn, either piecemeal or by pulling the entire bin out of the opening in preparation for dumping the contents onto the remaining surface of the play table. If the bin has been removed, it is returned to its place within the opening. The panel is returned to its position overlying the opening, thus restoring the surface area of the table top to its entirety. When the articles need to be returned to a storage bin, the appropriate panel is removed and the articles are either placed in the bin or pushed or swept from the table top so as to fall into the bin.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A table for storing articles, the table comprising:
a frame;
a horizontal work surface defining a plurality of openings, the work surface being supported by said frame;
a plurality of bins removably suspended from said work surface within said openings; and
a plurality of flat removable lids covering said bins, each of said lids associated with one of said bins and dimensioned to completely cover said associated bin when said panel is over said associated bin, said lids further dimensioned to cover substantially all of said work surface and bins when all of said lids are over said bins, said lids generally abutting one another to provide a substantially continuous planar surface, whereby objects resting on said lids can be transferred to a selected bin by removing the lid associated with the selected bin and sweeping the objects across the unselected lids and into the selected bin.

2. The table of claim 1, said frame defining a horizontal groove, said work surface being fitted into said groove, whereby said frame extends above said work surface.

3. The table of claim 2, each of said bins includes a lip engaging said work surface.

4. The table of claim 3, each of said lids having a notch for grasping said lid to lift said lid from atop said bins.

5. The table of claim 1, each of said bins having a lip engaging said work surface.

6. The table of claim 5, each of said lids having a notch for grasping said lid to lift said lid from atop said bins.

7. The table of claim 1, each of said lids having a notch for grasping said lid to lift said lid from atop said bins.

8. A table for storing articles, the table comprising:
a frame;
a board supported by the frame, said board having a top surface and defining a plurality of openings each including a shoulder disposed below said top surface;
a plurality of bins each positioned within one of said openings, each of said bins having a lip engaging the associated shoulder, whereby each of said bins is suspended from said board; and
a plurality of panels selectively covering said bins, each of said panels associated with one of said bins and dimensioned to completely cover said associated bin when said panel is over said associated bin, said panels further dimensioned to cover substantially all of said work surface and bins when all of said panels are over said bins, said lids abutting one another to provide a substantially continuous planar surface, whereby objects resting on said lids can be transferred to a selected pin by removing the panel associated with the selected bin and sweeping the objects across the unselected panels and into the selected bin.

9. The table of claim 8, wherein each said lip has a top surface lip being flush that does not extend above said top surface of said board.

10. The table of claim 9, each of said panels having a notch for grasping said panel to lift said panel from atop said bins.

11. The table of claim 10, said frame having at least three sides, said board being fitted into horizontal slots in the sides of said frame, whereby the top of said frame is disposed above said board.

12. The table of claim 8, each of said panels having a notch for grasping said panel to lift said panel from atop said bins.

13. The table of claim 12, said frame having at least three sides, said board being fitted into horizontal slots in the sides of said frame, whereby the top of said frame is disposed above said board.

14. The table of claim 8, said frame having at least three sides, said board being fitted into horizontal slots in the sides of said frame, whereby the top of said frame is disposed above said board.

15. A table for storing articles, the table comprising:

a plurality of frame members each having a horizontal groove;

means for inter-securing said frame members;

a board defining a plurality of openings, said board being fitted into said horizontal grooves, whereby said frame members extending above said board;

a plurality of bins each suspended from said board within one of said openings; and a plurality of panels each associated with the covering one of said bins, each of said panels dimensioned to completely cover said associated bin when said panel is over said associated bin, said panels further dimensioned to cover substantially all of said board and bins when all of said panels are over said bins, said panels generally abutting one another to provide a substantially continuous planar surface, whereby objects resting on said panels can be transferred to a selected bin by removing the panel associated with the selected bin and sweeping the objects across the unselected panels and into the selected bin.

16. The table of claim 15 wherein each of said panels includes a notch for grasping said panel to lift said panel from atop said bin.

17. The table of claim 15 wherein said board includes a top surface and a recessed shoulder about the periphery of each opening disposed below said top surface; and each of said bins having a lip, the lip engaging said associated shoulder to be supported by the shoulder, whereby said bin is suspended from said board.

18. A storage table comprising:

a table top having an upper work surface defining a plurality of bin openings;

a plurality of bins, one of said bins being removably positioned within each of said openings, suspended from said table top, and being flush with or recessed below said work surface; and a plurality of cover panels, each of said panels being associated with and removably located over one of said bins, each of said panels dimensioned to completely cover said associated bin when said panel is over said associated bin, said panels further dimensioned to cover substantially all of said board and bins when all of said panels are over said bins, said panels generally abutting one another to provide a substantially continuous planar surface, whereby objects resting on said panels can be transferred to a selected bin by removing the panel associated with the selected bin and sweeping the objects across the unselected panels and into the selected bin.

19. A storage table as defined in claim 18 further comprising a peripheral shoulder about the periphery of said table top, said shoulder extending above said panels to reduce the likelihood that articles on said work surface will inadvertently fall therefrom.

20. A storage table as defined in claim 19 further comprising a frame supporting and entrapping the periphery of said table top, said frame providing said shoulder.

* * * * *